United States Patent [19]

Baxter

[11] Patent Number: 4,631,141

[45] Date of Patent: Dec. 23, 1986

[54] ACTIVATION

[75] Inventor: Paul L. Baxter, Cheshire, England

[73] Assignee: Interox Chemicals Limited, London, England

[21] Appl. No.: 819,276

[22] Filed: Jan. 16, 1986

[30] Foreign Application Priority Data

Jan. 30, 1985 [GB] United Kingdom ..... 8502374

[51] Int. Cl.[4] ..... C11D 7/20

[52] U.S. Cl. ..... 252/95; 252/99; 252/133; 252/135; 252/174.25; 252/186.38; 252/183.43; 8/111

[58] Field of Search ..... 252/95, 99, 133, 135, 252/174.25, 186.38, 186.43; 8/111

[56] References Cited

U.S. PATENT DOCUMENTS 4,086,175 4/1978 Kravetz et al. ..... 252/186.38
4,488,980 12/1984 Oakes ..... 252/99
4,490,274 12/1984 Maslyaev et al. ..... 252/186.38

FOREIGN PATENT DOCUMENTS 1120944 7/1968 United Kingdom .

*Primary Examiner*—A. Lionel Clingman
*Assistant Examiner*—Hoa V. Le
*Attorney, Agent, or Firm*—Larson and Taylor

[57] ABSTRACT

The bleaching performance of hydrogen peroxide or persalts developing it in situ is markedly lower at lower washing temperatures from ambient to 60° C. than at hot washing temperatures of around 90° C. or above.

The present invention relates to compositions and processes employing a minor amount of mixed oxides of calcium, barium or strontium with manganese which activate hydrogen peroxide bleaching and washing of stains at lower wash temperatures in spite of the fact that the compounds are substantially water-insoluble.

Suitable mixed oxides include those represented by formula $M_xMnO_y$ in which M represents the alkaline earth metal, x ranges from 1 to 2 and y ranges from 3 to 4.

25 Claims, No Drawings

ACTIVATION

The present invention relates to bleaching and washing employing hydrogen peroxide as such or in the form of persalts or adducts thereof which release it into or generate it in aqueous solution and to compositions for bleaching or washing, and in particular to compositions and processes in which the hydrogen peroxide is activated by a transition metal.

Hydrogen peroxide, persalts or hydrogen peroxide adducts have been commonly included in or employed with washing compositions in order to bleach a range of stains, especially soluble stains, and thereby enhance the washing performance of the washing composition. It is most effective at washing temperatures at or approaching the boiling point of the washing liquor, but is less effective at lower washing temperatures of from ambient to 60° C. These lower temperatures are being used to an increasing extent following the substantial real increase in energy prices during the 1970s. Consequently, much research has been devoted to activating hydrogen peroxide so as to achieve similar bleach effectiveness at ambient to 60° C. to that formerly attainable only at temperatures at or near boiling point.

One class of activators that has periodically received attention comprises that of transition metals, of which one member is manganese.

Its use in conjunction with certain complexing agents has been suggested in EP-A-72166 and with carbonate in EP-A-82563. In both instances, though, the manganese was added in the form of a water-soluble salt. Soluble manganese salt, however, is readily complexed by some of the sequestrants commonly incorporated in current-day heavy duty washing formulations, to the detriment of its catalytic effect on bleaching.

In the course of investigating the effects of transition metal compounds, various insoluble manganese compounds were tested in addition to the soluble ones. The insoluble ones were found to cause little or no activation of the hydrogen peroxide bleach in demineralised water.

It has also been suggested in GB No. 1120944 that bleaching powders for hard surfaces can be activated by incorporating with the persalt a catalyst in which Co, Mn, Ni, Cr, Mo or Cu metal ions absorbed in insoluble or scarcely soluble substrates of Zn, Cd, Ca, Ma, Al, Sn, Be, Ti, Sb, Bi or $SiO_2$ compounds. Activation is demonstrated only for Co cations, so that it is only by inference that the remaining transition metals listed including zinc, cadmium, magnesium and aluminium impair bleaching. Consequently, GB No. 1120944 is unable to provide reliable teaching as regards the use of manganese compounds for bleach activation.

It has now been found that hydrogen peroxide can be activated using certain water-insoluble compounds comprising particulate mixed oxides of manganese and certain alkaline earth metals, thereby avoiding the requirement for soluble manganese salts.

According to a first aspect of the present invention, there is provided a bleach composition comprising a particulate mixture of an hydrogen peroxide-developing persalt and an insoluble mixed oxide of calcium, barium or strontium and manganese, and according a related second aspect there is provided a washing composition containing the bleach composition and at least one surface active or detersive agent.

According to a third aspect of the present invention there is provided a process for bleach activation in which an aqueous alkaline solution of hydrogen peroxide or a hydrogen peroxide adduct is brought into contact with a catalytic amount of a particulate substantially water-insoluble mixed oxide of manganese and an alkaline earth metal selected from calcium, barium and strontium.

In general the insoluble mixed oxides can be represented by the general formula $M_x$ Mn $O_y$ in which M represents one of the three selected alkaline earth metals, x ranges from 0.1 to 3, preferably 1 to 2 and y ranges correspondingly from 1.5 to 5, preferably 3 to 4, often obeying the expression $x+2=y$ to a first approximation. Especially favoured mixed oxides are $CaMnO_3$ and $Ca_2MnO_4$ or mixtures thereof. For the avoidance of doubt, the term 'mixed oxide' herein indicates that the compound is an oxide derivative of both manganese and the alkaline earth metals and is not simply a particulate mixture of manganese oxides and alkaline earth metal oxides.

Advantageously, by incorporating such mixed oxides in bleaching/washing compositions or processes employing or developing hydrogen peroxide in situ, activation can occur irrespective of whether the process water is hard or soft and guarantees that the manganese and calcium remain in association during any preceding handling or storage of the activating material before its use in bleaching/washing, thereby ensuring that activation can occur in use. Both advantages are of considerable practical value. Furthermore, and especially for the $CaMnO_3$ mixed oxide a very wide variation of concentration of the mixed oxide can be tolerated whilst providing a very similar degree of bleach activation. This overcomes virtually completely any problems of impaired performance caused by inadvertant overdosing of manganese into the washing solution caused for example by an over-zealous user using a substantial excess amount of bleach additive in the hope of further improving performance.

It is preferable to employ the mixed oxide catalyst in the form of a powder preferably having a particle size of below 0.25 mm. In practice, many of the particles fall in the range of 0.02 mm to 0.125 mm, that is to say pass through a fine mesh sieve having mesh number 120.

It is desirable to incorporate at least 1 mg/l Ca/Mn, Ba/Mn or Sr/Mn mixed oxide in washing/bleaching solutions in order to activate hydrogen peroxide, and preferable to incorporate at least 2 mg/l. In many instances, the concentration of the mixed oxide is selected within the range of 4 mg/l to 120 mg/l. For $Ca_2MnO_4$ it is preferable to restrain its use to below 70 mg/l and preferably up to 40 mg/l is used in view of its tendency to activate to a decreasing extent as its concentration increases above the optimum range of 5 to 30 mg/l. For $CaMnO_3$ and $BaMnO_3$, the extent of activation continues to increase and remains high as its concentration increases up to around 60 mg/l. Accordingly, its concentration is preferably selected in the range of 20 to 60 mg/l, though of course amounts in the range 60 to 120 mg/l can be used if desired. Naturally, if mixtures of the mixed oxides are used, the total concentration selected will take into account the relative proportions of each.

An alternative way of expressing the content of activator is relative to the hydrogen peroxide bleach. Expressed in terms of moles manganese in the mixed oxide and moles hydrogen peroxide added as such or in the form of a persalt, the ratio is often selected in the range of from 15 to 1500 moles hydrogen peroxide per mole mixed oxide catalyst, and especially in a ratio of up to 200 moles per mole. In the case of $CaMnO_3$, it is preferable to use at least 25 moles hydrogen peroxide per mole catalyst and in the case of $Ca_2MnO_4$ is preferable to use at least 60 moles hydrogen peroxide per mole catalyst. Where a mixture of catalysts is used the preferred lower limit can be calculated proportionately between 25 and 60 depending on the mole ratio of the catalysts between themselves.

It will be recognised that the catalyst and hydrogen peroxide can be added separately in the washing process and indeed it would be convenient to so do if hydrogen peroxide were being added as such or if the catalyst were being introduced as an additive to complement a detergent composition containing a persalt or hydrogen peroxide. However, where the bleach is a solid, it is extremely convenient to make a solid mix of particulate catalyst and persalt in the mole ratio ranges specified for the washing/bleaching process, sometimes otherwise referred to as bleach additive compositions. Naturally, the weight proportions of the two components in the bleach additive depends not only upon their mole ratio but also upon their molecular weights. However, the proportion of catalyst in the persalt/catalyst mixture is unlikely to exceed 12% parts and is usually at least 0.05 parts the balance being persalt to a total of 100 parts, all parts being by weight. In many instances the proportion of catalyst is selected in the range of 0.5 to 6 parts and the persalt 99.5 to 94 parts, especially when employing a persalt having an avox. in the region of 10 to 16% w/w, such as sodium percarbonate or sodium perborate mono or tetrahydrate, or mixtures of them.

It is not essential for the entire bleach additive composition to consist of bleach and catalyst. In addition, such a composition can include one or more components that typically act as detergent builders or simply be inert materials, provided that the ratio of bleach to catalyst remain in the aforementioned ranges of ratios. Such additional components can in theory provide even a major proportion of the bleach additive composition but in practice usually total less than 85% w/w. Such components can include sodium sulphate and non-phosphate builders such as zeolites A, X or Y or sodium citrate or sodium carbonate/bicarbonate.

The present invention includes in a further aspect solid washing compositions that contain one or more surfactants in addition to the bleach, catalyst and optionally the builder and/or diluent and/or other detergent adjuncts.

The washing compositions can tolerate wide variations in the relative proportions of their components. Thus, the total of persalt plus catalyst can comprise 1 to 50%, often 5 to 25%, the surfactants can comprise 1 to 80%, often 5 to 40%, the builder can comprise 1 to 80%, often 5 to 10%, diluent from from 0 to 40% and adjuncts 0 to 20%, all %s being by weight based on the washing composition.

In practice, the surfactant can be any type or mixture that is inherently capable of being employed in solid persalt-containing washing compositions. The permissible types include anionic, nonionic, zwitterionic and cationic. Suitable representative surfactants are specified in Surface Active Agents by Schwartz and Perry (Volume 1—1949) and Schwartz, Perry and Berch (Volume 2—1958), published by Interscience. A selection of some of the more common/important ones are briefly described below.

The anionic surfactants are normally alkali metal, especially sodium or sometimes potassium salts, or ammonium salts, or, if desired, a part thereof can be in the form of calcium salts, thereby simultaneously contributing to the detergency of the system whilst providing calcium to promote the manganese activation. One or more anionic surfactants are often selected from linear alkyl benzene sulphonates, especially having $C_9$–$C_{15}$ in the alkyl chain, alkyl sulphates, particularly $C_{10}$–$C_{22}$, olefin sulphonates, particularly $C_{10}$–$C_{24}$, alkane and/or hydroxyalkane sulphonates, often $C_{10}$–$C_{24}$, alkyl phenoxy ether sulphates, often with $C_8$–$C_{12}$ alkyl chain and 1–10 ethylene oxide units, alkyl ether sulphates often with $C_{10}$–$C_{20}$ alkyl chain and 1–10, preferably 2–4 ethylene oxide units and soaps particularly $C_{12}$–$C_{20}$. Various other anionic surfactants often provide at least part of the total added including sulphocarboxylates, alkyl glceryl ether sulphonates, monoglyceride sulphates and sulphonates, and phosphated ethylene oxide-based nonionic surfactants.

The nonionic surfactant for incorporation in the invention washing compositions generally comprise condensation products of ethylene oxide and propylene oxide, typically 5–30 units, with an aliphatic or aromatic alcohol or an aliphatic acid amine or amide. In such nonionic surfactants, the hydrophobic aliphatic moiety often has a chain length of $C_8$–$C_{22}$ in wholly aliphatic compounds or is $C_6$–$C_{12}$ when present in an alkyl aromatic group. Other usable nonionic surfactants are condensates of glycerol and sorbitol.

It is convenient, usually to employ both an anionic surfactant component and a nonionic surfactant component in washing compositions, in a weight ratio often from 10:1 to 1:10.

Semipolar surfactants are useable herein and include water-soluble amine oxides, phosphine oxides and sulphur oxides, each containing a $C_{10}$–$C_{22}$ alkyl chain and often 2 $C_2$–$C_3$ alkyl chains.

Zwitterionic surfactants herein are often selected from water-soluble derivatives of aliphatic quaternary ammonium, phosphonium and sulphonium cationic compounds in which the aliphatic moieties are straight or branched, and in which one substituent is $C_8$–$C_{18}$ and one terminates in an anionic water-solubilizing group, especially a sulphonate group for example alkyl-hydroxy-propane-sulphonates and alkyl-dimethyl-ammonio-hydroxy-propane-sulphonates.

The cationic surface active agents when employed are often selected from quaternary ammonium compounds having one or two $C_8$–$C_{20}$ straight or branched hydrophobic groups, e.g. cetyl trimethyl ammonium bromide or chloride, dioctadecyl dimethyl ammonium chloride, and the fatty alkyl amines.

It is preferable for the washing compositions to be either free from phosphate/phosphonates or to contain not more than a small proportion such as less than 5%, particularly less than 2% w/w. The preferred builders are those which are relatively poor calcium complexers. It is preferable for the detergent builders to be selected from water-soluble or insoluble particulate builders including alkali metal silicates, zeolites that obey the general formula $(M_2O)_x \cdot (Al_2O_3) \cdot (SiO_3)_y$ in which M is a monovalent metal especially sodium, x is 0.7 to 1.5 and y is 1.3 to 4.0, including zeolites A and X and mixtures thereof, alkali metal carbonate/bicarbonates, and alkali metal citrates. Such builders are regarded as compatible. It will be recognised that a plurality of these builders may be employed in varying ratios at the discretion of the washing composition formulator. Indeed, and by way of example only such builder mixtures can include mixtures of carbonates with silicate, carbonates with citrates, and citrates with silicates, or all three, silicate indicating in itself either water-soluble alkali metal silicates or particulate zeolite materials or any mixture thereof in all instances as desired. In many practical washing compositions, the overall builder concentration will range from 30 to 70% of the total composition.

When a processing aid (filler) is present, it is preferably sodium sulphate and inclusion of alkali metal chloride as filler can also be tolerated.

The detergent auxiliary agents (adjuncts) present are normally selected from soil antiredeposition agents, dye transfer inhibitors, optical brightening agents, peroxy stabilisers, corrosion inhibitors, bactericides, foam enhancers, foam inhibitors, thickeners, absorbents, abrasives, diluents, dyes, perfumes and proteolytic enzymes. Amongst the auxiliary agents, carboxymethyl cellulose salts and polyvinylpyrrolidines deserve mention as SARDs, in that their presence ameliorates or completely cures any deposition on the fabric of catalyst or manganese derivative compound which could otherwise occur, especially after multiple washing of any article. Accordingly, it is beneficial to employ rather more SARD than in a corresponding but manganese catalyst-free composition, for example using from ½ to 2% rather than less than ½%. Among other adjuncts, there deserves mention of the various aminocarboxylates, aminomethylenephosphonates, hydroxy quinolines and dipicolinic acid as peroxy stabilisers and/or dye transfer inhibitors, silicates for corrosion inhibition, quaternary ammonium or pyridinium halides as bactericides, alkanolamides and ethylene oxide/propylene oxide copolymers to regulate foaming. Derivatives of diaminostilbene sulphonic acid, diarylpyrazolines and aminocoumarins are examples of OBA's, anhydrous sodium sulphate is an example of absorbents and diluents, silica or maleic modified cellulose, polyethylene oxide, e.g. above MW of 10,000, maleic anhydride copolymers with ethylene, styrene or methylvinyl ether, especially above 50,000 MW, or polyvinyl pyrrolidine as a thickener, and silica or kieselguhr as abrasives. Naturally, it is preferred to select dyes and perfumes known not to interact readily with peroxygen compounds, and to coat any enzyme with water soluble/dispersible coating for storage protection.

It will be recognised that where the catalyst composition and surfactant-containing composition are introduced separately, the latter composition can if desired comprise particulate solids, as described hereinbefore in the context of a composition containing both catalyst and surfactant, or alternatively liquid heavy duty detergent compositions can be used.

The concentration of washing composition used either in conjunction with catalyst and bleach composition or alternatively containing the catalyst and persalt, can be employed over a very wide range of concentrations. Even when used in domestic washing machines a wide range of concentrations may be employed depending upon the prevalent local practices, including in particular the ratio of liquor to weight of articles being washed. Thus, the range currently envisaged spans from 0.5 g/l per liter of washing composition up to 25 g/l. It will accordingly be recognised that the concentration of catalyst in those compositions destined for use at very low liquor ratios is preferably somewhat lower than in those compositions destined for the American market with long liquor ratios, often by a factor of about 5 to 10, so that variation in the concentration of manganese in the washing solution is small.

The bleaching/washing processes of the present invention are preferably carried out at a pH of from pH 5 to 11 and often from pH 9 to 10.5. A pH within the aforementioned ranges can usually be obtained by dissolution of the bleach additive or washing composition or by a built detergent composition plus bleach. Where the catalyst is being employed with hydrogen peroxide it may be more convenient to add an alkali to bring the solution to the desired pH range. The processes normally employ a peroxide or persalt concentration of at least 2 millimoles per liter and in practice the concentration is often selected in the range of 5 to 25 millimoles per liter. Use of higher concentrations, for example up to 50 or even up to 100 millimoles of bleach per liter can be contemplated at the discretion of the user, particularly in the context of low liquor ratio machines.

The processes for washing articles according to the present invention can be carried out at a temperature from ambient temperature up to the boiling point of the washing solution. Compositions according to the present invention are particularly well suited to a process at which washing or bleaching is carried out by steeping at ambient or by heating the solution from ambient to a temperature selected in the range of from about 25° to 60°. Alternatively the washing and bleaching processes may be effected by heating up a cold washing solution. A combination of processes can be used, such as cold steeping followed by a wash at 30°, 40°or 50° C. Naturally, a variety of process combinations can be used. Thus, in one set of combinations a solution of the bleach composition, buffered to alkaline pH can be employed as a pre-wash treatment, either by steeping at ambient or in a short wash cycle at up to 60° C. followed by a wash using a fully formulated detergent composition, which may be a composition as described herein or different.

In general, the rate of removal of stains is enhanced by employing a higher temperature within the range of ambient to 60° C. and by higher Avox. concentrations, but by virtue of the rate at which the invention washing compositions dissolve or are dispersed in the wash solution, the contact period between solution and fabric can conveniently be as short as 5 minutes. Longer periods of for example typically 10 to 30 minutes and up to 1 hour tend to provide greater soil removal. In cold washing or steeping even longer periods can be employed, such as steeping overnight.

The foregoing passages contemplate the use of the insoluble mixed calcium/manganese oxides in water to which no additional calcium has been introduced, thereby achieving enhanced stain bleaching. By so doing, the amount of calcium that is introduced in order to promote manganese activation is extremely low, of the order of 1 to 2 moles per mole manganese. This of course is beneficial in that it minimises any interaction with the builder, leaving the latter to perform its other useful functions and minimise calcium deposition on washed fabric. However, in other embodiments, the calcium present in the mixed oxides can be augmented by additional and water-soluble calcium salts which can lead to faster and more efficient stain removal, especially when using $Ca_2MnO_4$. Any sufficiently water-soluble salt of calcium is suitable such as the chloride, nitrate, acetate or propionate, usually at a mole ratio of not more than 200:1 Ca:Mn. Indeed, some encouraging results were obtained even at 25:1 mole ratio. Accordingly in some of embodiments of the instant invention, the washing process employs or the bleaching additive or washing composition contains up to 200 moles of a water-soluble calcium salt per mole of mixed oxide catalyst. As a consequence of such amounts of extra material being added to the compositions, the % ranges for weight proportions of bleach and catalyst are correspondingly and proportionally reduced. For example, where the bleach additive composition in the absence of added soluble calcium contained 0.5 to 4% catalyst, then as the amount of calcium progressively increases to 200 moles per mole Mn in the catalyst, so the catalyst range progressively falls to the range 0.25 to 0.45%, the bleach to the range 49.75% to 10.7% and the soluble calcium salt weight proportion increases up to 50 to 88.85%. At an intermediate soluble calcium addition amount of 25:1 mole ratio, the corresponding ranges are catalyst 0.45 to 2%, bleach 88.45 to 48% and soluble calcium 11.1 to 50% w/w. It will be recognised that similar adjustments can be made to the proportions of the other solids in the washing compositions likewise. Compositions or processes with added soluble calcium are of especial interest and value in soft water areas.

It will also be understood that the instant invention catalysts compositions and processes can be used together with, if desired, soluble manganese salts as well as soluble calcium salts.

Having described the invention in general terms, specific embodiments will now be given in more detail by way of example only.

EXAMPLES 1 TO 10 AND COMPARISON A

In each of these Examples and Comparison, swatches of red wine stained cotton cloth were washed for 20 minutes in an aqueous alkaline solution of hydrogen peroxide (1 g/l of 35% w/w technical grade commercially available from Interox Chemicals Limited) in demineralised water buffered to pH 10 with sodium hydroxide at 40° C. employing a laboratory scale washing machine available from US Testing Corporation under their Trademark (registered in some countries) TERGOTOMETER. In each Example, the specified mixed oxide catalyst was employed at the concentration shown in Table 1, in the form of the particles' fraction that passed through a fine mesh sieve having mesh number 200, 1.0, particles with a nominal particle diameter of −0.075 mm.

The reflectance of each swatch was measured before and after washing, respectively $R_s$ and $R_w$, and compared with the reflectance of the prestained cloth, $R_c$. The washed swatch was rinsed with cold water and air dried before its reflectance was measured, All measurements were made using an Instrumental Colour Systems MICROMATCH (Trademark registered in some countries) reflectance spectrophotometer equipped with a Xenon lamp light source filtered to approximate daylight.

The percentage stain removal was calculated for each swatch using the formula:

$$\% \text{ Stain Removal} = 100 \times (R_w - R_c)/(R_s - R_c)$$

and are also shown in Table 1 below.

TABLE 1

| Comparison Example | Catalyst | Amount mg/l | % Stain Removal |
|---|---|---|---|
| A | — | — | 33 |
| 1 | $CaMnO_3$ | 1.3 | 38 |
| 2 | $CaMnO_3$ | 5 | 46 |
| 3 | $CaMnO_3$ | 10 | 50 |
| 4 | $CaMnO_3$ | 15 | 53 |
| 5 | $CaMnO_3$ | 50 | 56 |
| 6 | $Ca_2MnO_4$ | 1.8 | 42 |
| 7 | $Ca_2MnO_4$ | 7 | 47 |
| 8 | $Ca_2MnO_4$ | 10 | 47 |
| 9 | $Ca_2MnO_4$ | 20 | 49 |
| 10 | $Ca_2MnO_4$ | 50 | 43 |

From Table 1, it can be seen clearly that calcium manganese mixed oxides catalysed the bleaching of stain under alkaline conditions. Secondly, it will be apparent that the $CaMnO_3$ oxide was more active than the $Ca_2MnO_4$ oxide over a wide ange of concentrtions and thirdly, the similarity in performance of the $CaMnO_3$ oxide despite a substantial variation in its concentration is marked. Accordingly, Table 1 demonstrates that the activator is effective even in the softest water and can tolerate wide variations in concentration without any dramatic loss of washing capability.

Bleach catalyst compositions corresponding approximately to the additions of catalyst and hydrogen peroxide in the respective Examples are shown in Table 2 below in which PBS represents sodium perborate tetrahydrate, PBS1 sodium perborate monohydrate and PCS sodium percarbonate.

TABLE 2

| | Composition expressed in relative parts by weight | | |
|---|---|---|---|
| | Catalyst | Bleach | |
| Example No. | Amount | Compound | Amount |
| 2 | 0.45 | PCS | 99.55 |
| 3 | 0.6 | PBS | 99.4 |
| 4 | 1.5 | PBS1 | 98.5 |
| 5 | 3.0 | PBS | 97.0 |
| 9 | 1.8 | PCS | 98.2 |

The amounts used for Example 3 satisfy the requirements of Example 8 and those for Example 5 satisfy Example 10.

EXAMPLES 11 AND 12

In these Examples, the procedure of Examples 2 and 7 was repeated on the same apparatus on swatches of the same red wine stain, with the sole exception that additional soluble calcium salt ($CaCl_2 \cdot 2H_2O$) at 130 mg/l was introduced into the wash water with the mixed oxide catalyst. The resultant % stain removals were 57% for $Ca_2MnO_4$ and 49% for $CaMnO_3$ showing clearly that the soluble calcium promoted stain removal for both oxides but was especially successful at promoting $Ca_2MnO_4$.

COMPARISONS B AND C AND EXAMPLES 13, 14

These Comparisons and Examples were carried out in the same apparatus as the preceding Examples, also at 40° C. for 20 minutes wash on red wine stained swatches. The washing solution was obtained by dissolution of bleach, sodium perborate tetrahydrate (PBS) 1 g/l and either or both of a detergent base having the analysis shown below at 1 g/l and $CaMnO_3$ mixed oxide at 50 mg/l.

The detergent base comprised (% w/w) 10.5% anionic surfactants, 10.5% nonionic surfactant, SARD and other nonionic organic substances, 0.9% phosphate, 33.7% zeolite A, 41% sodium bicarbonate, a trace of borax and the balance water.

The bleaching system and performance are shown in Table 3.

TABLE 3

| Example/ Comparison | PBS | System Base | Catalyst | % Stain Removal |
|---|---|---|---|---|
| B | + | | | 44 |
| 13 | + | | + | 56 |
| C | + | + | | 43 |
| 14 | + | + | + | 51 |

Table 3 shows that stain removal was enhanced by addition of the catalyst, even in the presence of a detergent base containing a substantial proportion of zeolite builder. When trials C and 14 were repeated using instead water-soluble manganese and calcium salts, at concentrations of 9 and 900 micromoles per liter respectively for 10 minutes at 32° C. only 1%, not a significant difference, was found between them. This indicates that the insoluble catalysts in the instant invention form a more tolerant system.

COMPARISON D AND EXAMPLES 15, 16

In this Comparison and Examples, the method, conditions and apparatus of Comparison A and Examples 3 and 5 were employed, but using $BaMnO_3$ instead of $CaMnO_3$ and a different batch of red wine stains. The $BaMnO_3$ catalyst particles had also passed through a 200 mesh number fine mesh sieve.

TABLE 4

| Comparison Example | Catalyst | Amount mg/l | % Stain Removal |
|---|---|---|---|
| D | — | — | 22 |
| 15 | $BaMnO_3$ | 10 | 35 |
| 16 | $BaMnO_3$ | 50 | 42 |

From Table 4, it can be seen clearly that the barium manganese mixed oxide exhibits the same profile of bleach activtor concentration as does the calcium manganese mixed oxide.

EXAMPLES 17 to 19

Examples of particulate washing compositions containing bleach plus catalyst are summarised in Table 5 below, in which LAS indicates a linear alkyl (av $C_{12}$) benzene sulphonate-sodium salt and CMC carboxymethyl cellulose.

TABLE 5

| Component | % by weight in Example 17 | 18 | 19 |
|---|---|---|---|
| LAS | — | 10.0 | 5.0 |
| Alcohol ethoxylate | 2.0 | 2.0 | — |
| Soap | 1.0 | — | — |
| Sodium carbonate | 35.0 | — | — |
| Sodium silicate | 10.0 | — | — |
| Sodium citrate | — | 10.0 | 15.0 |
| Zeolite A | — | 30.0 | 20.0 |
| CMC | 0.5 | 0.5 | 0.5 |
| Fluorescer | 0.1 | 0.1 | 0.1 |
| Sodium sulphate | 25.0 | 20.0 | 35.0 |
| Sodium perborate tetrahydrate | 20.0 | — | 15.0 |

TABLE 5-continued

| Component | % by weight in Example 17 | 18 | 19 |
|---|---|---|---|
| Sodium percarbonate | — | 25.0 | — |
| $CaMnO_3$ | 0.8 | 1.0 | — |
| $BaMnO_3$ | — | — | 0.6 |
| Water | | balance | |

Compositions of similar effectiveness can be obtained by substituting 15% sodium perborate monohydrate for the sodium perborate tetrahydrate in Example 17 and increasing the sodium sulphate proportion to 30%.

EXAMPLE 20 AND COMPARISONS E AND F

In this Example and Comparisons the procedure of comparison A and Examples 1 to 10 was repeated, employing as catalyst in E, $CaMnO_3$ (50 mg/L) in Ex 20 and a mixture of particulate CaO (19.6 mg/L) and $MnO_2$ (30.4 mg/L) in F, and a fresh batch of red-wine stained swatches. The % stain removal of E and F was virtually identical being 28 and 27% respectively whereas using the invention catalyst, $CaMnO_3$, stain removal increased to 35%. This set of results demonstrates that the invention fused calcium/manganese oxide performs differently from and better than a simple mixture of calcium oxide and manganese oxide.

EXAMPLES 21 AND 22 AND COMPARISON G

In these Examples and Comparison, procedure of respectively Examples 3 and 5 and Comparison A was repeated but employing $SrMnO_3$ at 10/50 mg/L instead of $CaMnO_3$, and a further batch of red-wine stained swatches. The % stain removal increased from 54% in G to 67% and 68% respectively in Example 21 and Example 22.

I claim:

1. A bleach composition comprising a particulate mixture of a hydrogen peroxide-developing persalt and an insoluble mixed oxide of calcium, barium or strontium and manganese.

2. A composition according to claim 1 in which the mixed oxide is represented by the formula $M_xMnO_y$ in which M represents the alkaline earth metal, x ranges from 1 to 2 and y ranges from 3 to 4.

3. A composition according to claim 2 in which $x+2=y$ in the formula for the mixed oxide.

4. A composition according to claim 1 in which the mixed oxide is a calcium manganese oxide.

5. A composition according to claim 3 in which the mixed oxide is represented by the formula $CaMnO_3$ or $Ca_2MnO_4$ or $BaMnO_3$.

6. A composition according to claim 2 which comprises 0.05 to 12 by weight mixed oxide catalyst and 99.95 to 88 parts persalt.

7. A composition according to claim 6 in which the catalyst comprises 0.5 to 6 parts by weight and the persalt 99.5 to 94 parts.

8. A composition according to claim 6 or 7 in which the persalt has an avox of from 10 to 16% w/w.

9. A composition according to claim 8 in which the persalt is sodium percarbonate or sodium perborate mono or tetrahydrate or mixtures of them.

10. A composition according to claim 1 which contains up to 80% w/w of a solid detergent builder and/or solid inert material.

11. A composition according to claim 10 in which the additional component includes sodium citrate or carbonate/bicarbonate and/or sodium zeolites A, X or Y or sodium sulphate.

12. A composition according to claim 1, 6 or 10 which further contains up to 200 moles of a water-soluble calcium salt per mole of mixed oxide catalyst.

13. A composition according to claim 12 in which the salt is calcium chloride, nitrate, acetate or propionate.

14. A washing composition comprising a bleach composition according to claim 1 or 10, and further containing a surfactant.

15. A washing composition according to claim 14 which comprises 1 to 50% persalt plus catalyst, 1 to 80% surfactant, 1 to 80% builder, 0 to 40% diluent and 0 to 20% adjuncts, all %s by weight in the composition.

16. A process for bleach activation in which an aqueous alkaline solution of hydrogen peroxide or a hydrogen peroxide adduct is brought into contact with a catalytic amount of a particulate substantially water-insoluble mixed oxide of manganese and an alkaline earth metal selected from calcium, barium and strontium.

17. A process according to claim 16 in which the mixed oxide is incorporated in an amount selected in the range of 1 to 120 mg/l.

18. A process according to claim 16 or 17 in which the mixed oxide is represented by the formula $M_xMnO_y$ in which M represents the alkaline earth metal, x ranges from 1 to 2 and y ranges from 3 to 4.

19. A process according to claim 18 in which the amount of $Ca_2MnO_4$ incorporated is from 5 to 30 mg/l.

20. A process according to claim 18 in which the amount of $CaMnO_3$ incorporated is from 20 to 60 mg/l.

21. A process according to claim 16 employing 15 to 1500 moles hydrogen peroxide or persalt per mole of mixed oxide catalyst.

22. A process according to claim 21 in which the mixed oxide catalyst is represented by the formula $CaMnO_3$, $Ca_2MnO_4$, $BaMnO_3$ or $SrMnO_3$.

23. A process according to claim 16 carried out at a temperature of ambient to 60° C.

24. A process according to claim 16 carried out at a pH of from pH 7.5 to 11.

25. A process according to claim 16 effected by introduction into water of a preformed composition containing persalt and mixed oxide catalyst, optionally in conjunction with a base washing composition.

* * * * *